United States Patent [19]

Maruta et al.

[11] Patent Number: 4,745,441

[45] Date of Patent: May 17, 1988

[54] COPYING MACHINE CAPABLE OF FORMING FILING MARGINS ON BOTH SIDES OF COPY PAPER

[75] Inventors: Syuzi Maruta, Toyokawa; Masazumi Ito, Toyohashi; Tadashi Ohira, Toyokawa, all of Japan

[73] Assignee: Minolta Camera Kabushiki Kaisha, Osaka, Japan

[21] Appl. No.: 67,466

[22] Filed: Jun. 26, 1987

[30] Foreign Application Priority Data

Jul. 1, 1986 [JP] Japan ..... 61-154612

[51] Int. Cl.[4] ..... G03G 15/00

[52] U.S. Cl. ..... 355/14 R; 355/14 SH; 355/7; 355/3 SH; 355/24; 355/26

[58] Field of Search ..... 355/14 R, 14 SH, 7, 355/3 R, 3 SH, 23, 24, 25, 26, 55, 56

[56] References Cited

U.S. PATENT DOCUMENTS

| | | | |
|---|---|---|---|
| 4,129,377 | 12/1978 | Miyamoto et al. | 355/14 |
| 4,187,024 | 2/1980 | Satomi et al. | 355/14 R |
| 4,260,242 | 4/1981 | Nishikawa | 355/14 TR |
| 4,350,439 | 9/1982 | Tanioka et al. | 355/14 SH |
| 4,462,681 | 7/1984 | Aerts et al. | 355/14 SH |
| 4,501,490 | 2/1985 | Miyamoto et al. | 355/55 |
| 4,582,417 | 4/1986 | Yagasaki et al. | 355/14 R X |
| 4,616,269 | 10/1986 | Mori | 355/7 X |
| 4,655,580 | 4/1987 | Watanabe et al. | 355/14 R X |

*Primary Examiner*—A. C. Prescott

*Attorney, Agent, or Firm*—Price, Gess & Ubell

[57] ABSTRACT

A copying machine capable of forming filing margins on both sides of a copying paper forms a filing margin on one side of a copying paper by an ordinary method in which an image of document to be copied is reduced and shifted, and forms a filing margin on the other side of the copying paper by means of shifting the image in a direction opposite to the direction shifted in the ordinary method by the width of the filing margin. Accordingly, filing margins are correctly formed on both sides of the copying paper in the same marginal sides, respectively.

4 Claims, 9 Drawing Sheets

COPYING MACHINE CAPABLE OF FORMING FILING MARGINS ON BOTH SIDES OF COPY PAPER

BACKGROUND OF THE INVENTION

1. Field of the Invention

The present invention relates to a copying machine and, more specifically, to a copying machine capable of copying images on both sides of a single copying paper, respectively, on a reduced scale to provide appropriate filing margins on both sides of the copying paper, respectively.

2. Description of the Prior Art

A copying machine capable of copying images on both sides of a single copying paper has been proposed. This proposed copying machine comprises a duplex unit which inverts a copying paper having an image on one side and refeeds the inverted copying paper to the image forming unit.

There has also been proposed a copying machine capable of shifting an reduced image on a copying paper in the direction of conveyance of the copying paper to provide a filing margin on the copying paper.

In case of copying first and second single-sided documents or a double-sided document which have no filing margin on both sides of a single copying paper, respectively, by the conventional copying machine, the filing margin on the first side of the copying paper and the filing margin on the second side of the copying paper are formed on the opposite edges of the copying paper, respectively. Such filing margins cannot be used in filing the paper.

Such a failure in properly forming filing margins on both sides of a copying paper results because the copying paper is inverted by a duplex unit after the image of a document has been copied on the first side of the copying paper, and then the inverted copying paper is fed again to the image forming unit, so that a filing margin on the second side is formed on an edge opposite to the edge where a filing margin on the first side is formed.

For example, as shown in FIG. 2, when the image A of a first document is copied on the first side of a copying paper on a reduced scale, a filing margin a is formed adjacent to the trailing edge of the copying paper. This copying paper carrying the image copied on the first side is inverted so that the copying paper is turned upside down and the leading edge and trailing edge thereof are reversed, and then the inverted copying paper is stored in a temporary storage tray. Then, the inverted copying paper is fed in a direction indicated by an arrow E with the edge having the filing margin a running a head. Then, the image B of a second document is copied on the second side of the copying paper. Accordingly, the filing margins a and b are formed adjacent to the opposite edges of the copying paper, respectively.

SUMMARY OF THE INVENTION

The present invention has been made in view of such problems in the conventional copying machines and it is, therefore, an object of the present invention to provide a copying machine capable of forming filing margins on the first and second sides of a copying paper, respectively, adjacent to the same edge of the copying paper even in copying first and second documents each not having any filing margin on both sides of the copying paper, respectively, on a reduced scale.

To achieve the object of the invention, the present invention provides a copying machine comprising:

image forming means capable of operating in a single-side copying mode in which an image of a document is formed on one side of a copying paper, and in a double-side copying mode in which images of documents are formed on both sides of a copying paper, respectively, copying mode selecting means for selecting either the single-side copying mode or the double-side copying mode;

filing margin forming means for forming an image of a document on a copying paper on a reduced scale to form a filing margin in a direction of conveyance of the copying paper;

filing margin forming mode selecting means for actuating said filing margin forming means to form a filing margin; and control means for making the leading edge of a copying paper coincide with the leading edge of an image of a document in copying the image of the document on the first side of the copying paper and for making the leading edge of the copying paper coincide with the trailing edge of an image of a document in copying the image of the document on the second side of the copying paper, when both the double-side copying mode and the filing margin forming mode have been chosen.

When the double-side copying mode and the variable magnification shift mode are selected, the control unit provides a control signal to control the copying operation so that the image of a first document (or a second document) is copied on the first side of a copying paper on a reduced scale at the normal copying position, while the image of a second document (or the first document) is copied on the second side of the copying paper on a reduced scale at a copying position shifted from the normal copying position by a predetermined distance corresponding to the width of a margin provided by the reduced copying of the image so as to form a filing margin adjacent to the same edge where the filing margin on the first side is formed.

The copying position on the second side of the copying paper can be shifted from the normal copying position by the predetermined distance by a known method such as (1) a method of changing the copying paper feeding start timing by controlling the paper feeding mechanism by means of a timer, (2) a method of changing the document feed starting timing by controlling the document feeding mechanism by means of a timer, (3) a method of changing the exposure scanning start timing by controlling the exposure scanning mechanism by means of a timer, (4) a method of shifting the optical system for scanning a document to shift the position of the electrostatic latent image formed on the photosensitive body from the normal position, or (5) a method of shifting the document on the glass platen from the normal document mounting position. The reduction in size of the image of a document is achieved by shifting and turning the lens and mirrors of the scanning system.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF THE PREFERRED EMBODIMENTS

(The First Preferred Embodiment)

A first preferred embodiment of the present invention will be described hereinafter with reference to the accompanying drawings.

(Copying Machine)

Figure 1:
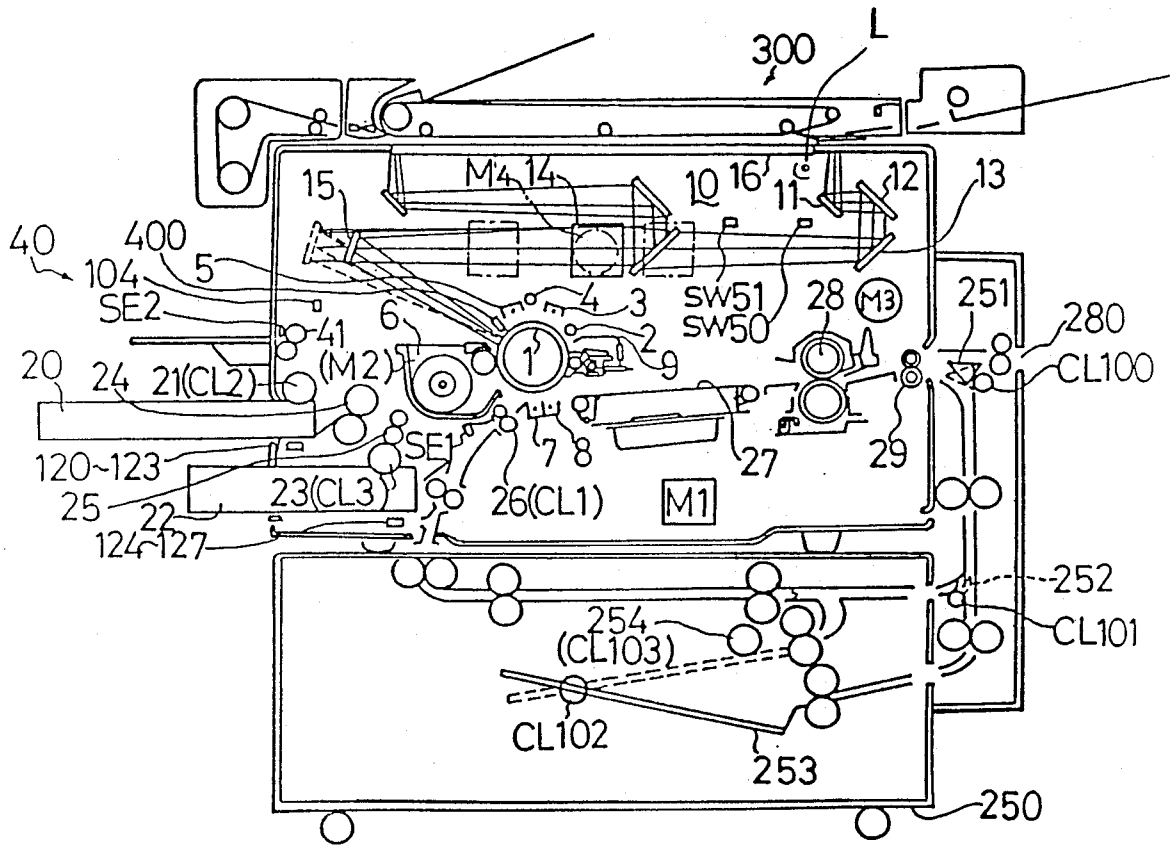
FIG. 1 is a schematic side elevation showing the constitution of the image forming unit of a copying machine, in a preferred embodiment according to the present invention.
Figure 2:
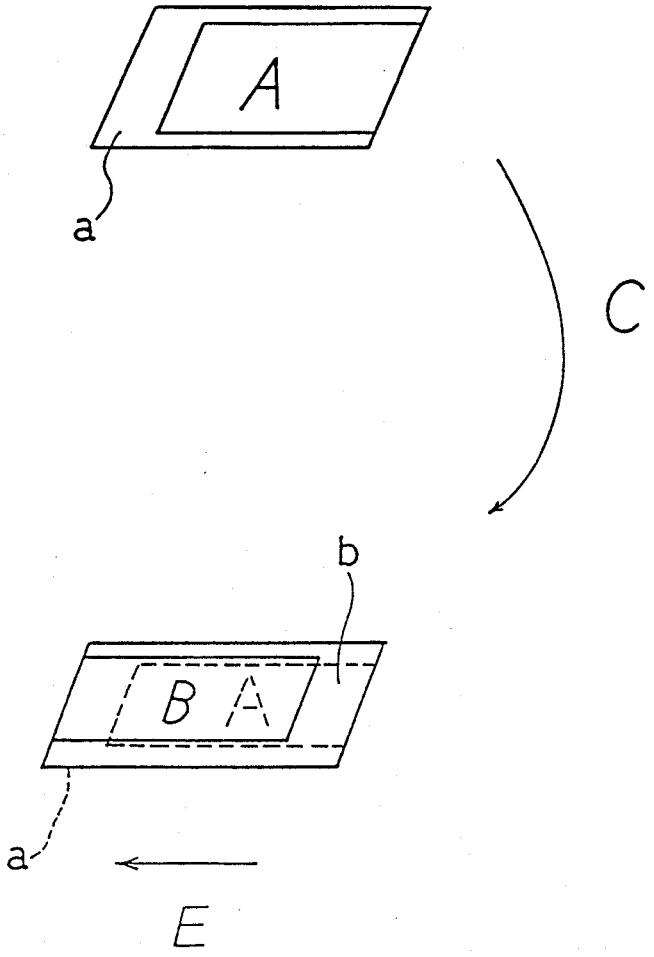
FIG. 2 is a view of assistance in explaining the respective copying positions on the first and second side of a copying paper when double-side copying is executed.

FIG. 1 is a schematic sectional view of a copying machine embodying the present invention.

A photosensitive drum 1 having a phtosensitive layer thereon is disposed substantially in the central portion of the copying machine is rotatable in a counterclockwise direction. Around the photosensitive drum 1 are arranged a main eraser lamp 2, an auxiliary charger 3, an auxiliary eraser lamp 4, a main charger 5, a selective eraser lamp 400, a developing unit 6, a transfer charger 7, a paper separating charger 8, and a blade-type cleaning unit 9. The photosensitive layer is erased and charged for sensitization by the eraser lamps 2 and 4 and the chargers 3 and 5, and then is exposed an optical image by an optical system 10.

The optical system 10, which is disposed below a glass platen 16 in order to scan an image of a document placed on the platen 16, comprises a light source L, movable mirrors 11, 12 and 13, a lens 14, and a mirror 15. The light source L and the movable mirror 11 are driven leftward for scanning operation at a speed v/m (v: a fixed circumferential speed of the photosensitive drum 1, m: a copying magnification) and the movable mirrors 12 and 13 are driven to the same direction at a speed of v/2m by a DC motor M3. In order to change the copying magnification, the lens 14 is shifted and the mirror 15 is moved and swung. Switches SW50 and SW51 are provided for determining the home position of the scanning system and for determining the registering timing for the scanning system, respectively.

Copying paper feed units 20 and 22 provided with feed rollers 21 and 23, respectively, are disposed on the left side of the photosensitive drum 1. A pair of rollers 24, a pair of rollers 25, a pair of timing rollers 26, a conveyor belt 27, a fixing unit 28, and a pair of discharge rollers 29 constitute a paper conveying path.

Indicated at 120 to 123 are paper code (size) detecting switches for the paper feed unit 20 and indicated at 124 to 127 are paper code detecting switches for the paper feed unit 22.

A sensor SE1 disposed before the pair of timing rollers 26 provides signals for controlling the pair of timing rollers 26.

A manual paper feed unit 40 is disposed above the paper feed unit 20. A copying paper inserted to the manual paper feed unit is delivered to the rollers 24 through a pair of rollers 41. A sensor SE2 for detecting a copying paper inserted to the manual paper feed unit 40 is disposed adjacent to the rollers 41.

A duplex unit 250 for double-side copying or for composite copying is disposed under the main body of the copying machine. The duplex unit 250 is provided with a discharge path changeover clutch CL100 for controlling a first chageover guide 251, and a composite copying path clutch CL101 for controlling a second chageover guide 252, to chageover the copying paper conveying path according to a selected copying mode among a normal single-side copying mode, a double-side copying mode and a composite copying mode. In the double-side copying mode, a copying paper carrying an image copied on one side thereof is stored temporarily in a temporary storage tray 253. When a secondary copying operation start signal is given, the temporary storage tray 253 is turned by a tray control clutch CL102 to a position indicated by broken lines, and then the copying paper stored in the temporary storage tray 253 is fed into the image forming unit by a refeed roller 254. Consequently, the copying paper is inverted and the leading edge and trailing edge of the copying paper are interchanged.

On the other hand, in the composite copying mode, the composite copying path clutch CL101 is actuated so that a copying paper delivered from the image forming unit is refed directly to the image forming unit bypassing the temporary storage tray 253, and the another image is copied over the image copied in the preceding copying cycle. A copying paper discharged from the duplex unit 250 through a discharge unit 280 is delivered to a sorter, not shown.

(Control Panel)

Figure 3:
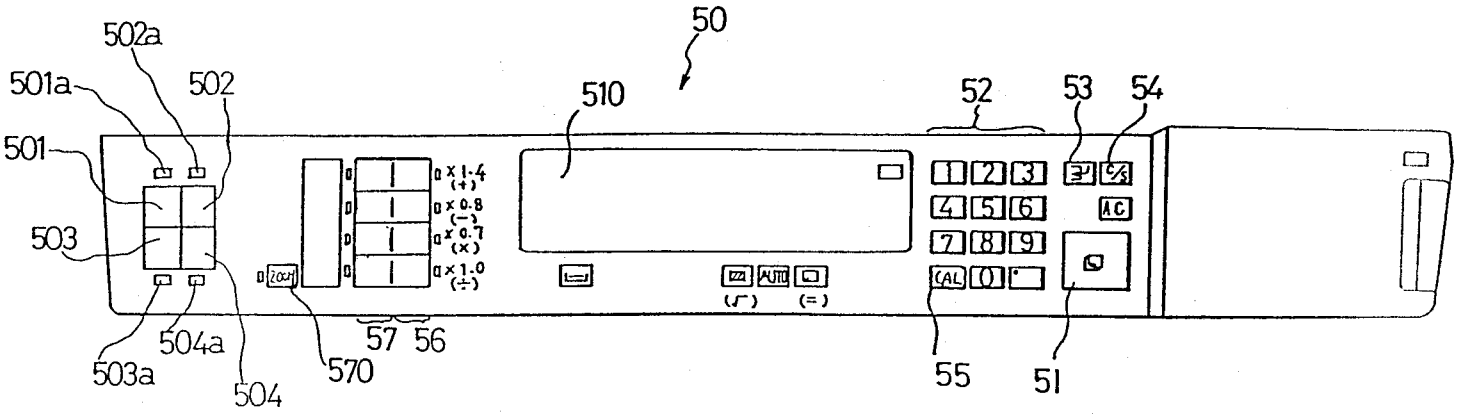
FIG. 3 is a plan view of a control panel incorporated into the copying machine of FIG. 1.

FIG. 3 is a plan view of a control panel 50 combined with the copying machine, showing the arrangement of control keys.

Arranged in the left end section of the control panel 50 are double-side copying mode key 501, single-side copying mode key 502, a variable magnification shift mode key 503 and a filing margin mode key 504. Pilot lamps 501*a*, 502*a*, 503*a* and 504*a* are provided near the associated keys 501, 502, 503 and 504, respectively.

Also provided on the control panel 50 are a print key 51 for starting the copying operation, a display 510 for displaying a value of four digits and information relating to the copying operation such as, for example, an indication of a first-side copying process or an indication of a second-side copying process, numeric keys 52 (keys for numerals 1, 2,. . . and 0), an interrupt key 53 for designating interrupt copying operation, a clear/stop key 54, a calculation mode key 55 for designating a calculation mode, and copying magnification setting keys 56 and 57.

The copying magnification setting keys 57 are used for setting an arbitrary copying magnification. When a zoom key 570 and either copying magnification setting key 57 are pressed, a value given by means of the numeric keys 52 and displayed on the display 510 is stored in a memory for the pressed copying magnification setting key 57 as a copying magnification. The copying magnification setting keys 56 are used for selecting a desired copying magnification among preset copying magnifications.

(Control Unit)

Figure 4:
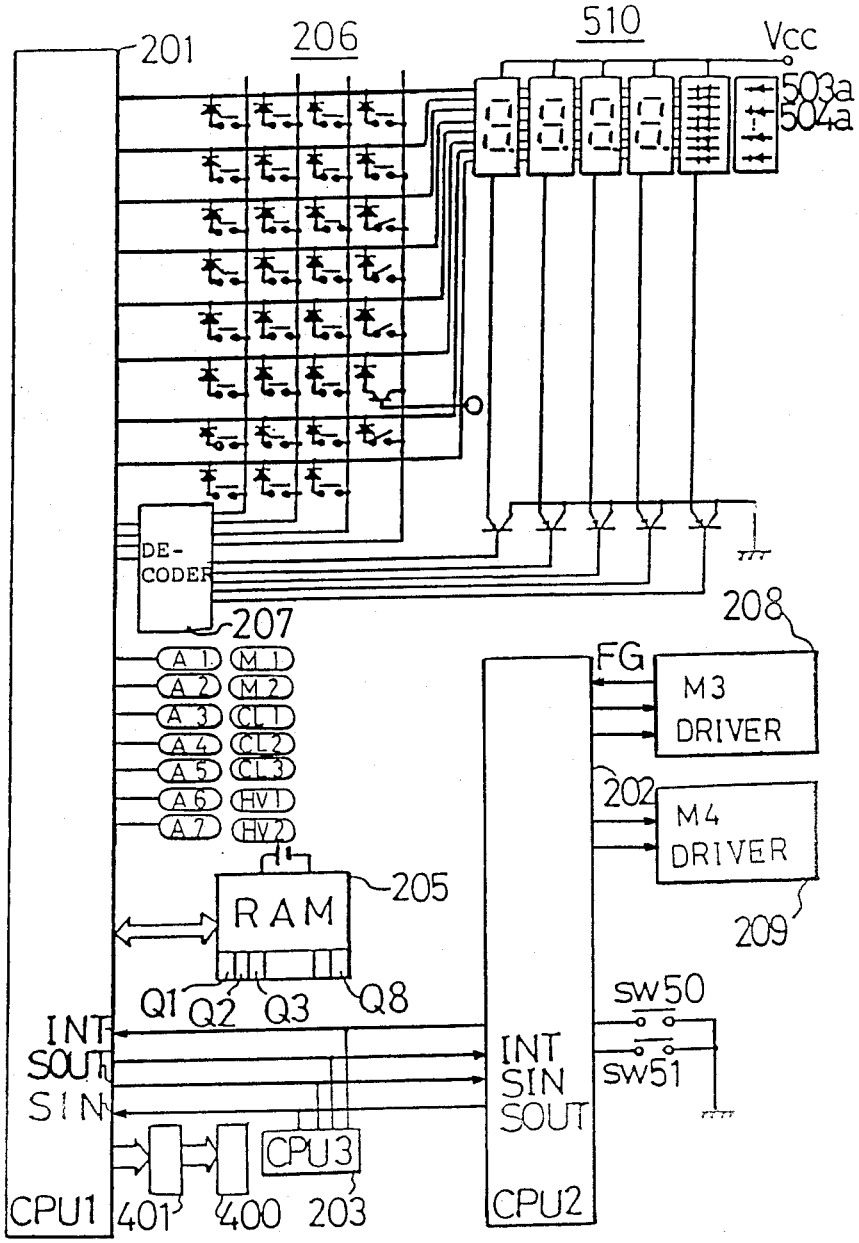
FIG. 4 is a block diagram showing the constitution of a control unit incorporated into the copying machine of FIG. 1.

Referring to FIG. 4 showing a control circuit associated with the copying machine of the present embodiment, a second CPU (central processing unit) 202 and a third CPU 203 are connected to the interrupt terminal INT, data input terminal Sin and data output terminal Sout of a first CPU 201.

The first CPU 201 gives a signal for controlling the selective eraser lamp 400 to an eraser controller 401. Also shown in FIG. 4 are a RAM (random access memory) 205 backed up by a battery, a switch matrix 206 and a decoder 207. Switching transistors, not shown, respectively for a main motor M1, a developing motor M2, a clutch CL1 for the timing rollers, a clutch CL2 for the paper feed roller 21, a clutch CL3 for the paper feed roller 23, the main charger 5 and the transfer charger 7 are connected to the output terminals A1 to A7 of the first CPU 201.

Data for controlling the copying operation and data fetched from a ROM (read-only memory) built in the first CPU are stored in the RAM 205. The RAM 205 has memories Q1, Q2, Q3 and Q4 corresponding to the copying magnification setting keys 57, and memories Q5, Q6, Q7 and Q8 corresponding to the copying magnification setting keys 56.

The second CPU 202 controls the optical system. A driving circuit 208 for driving a DC motor M3 for scanning operation, and a driving circuit 209 for driving a stepping motor M4 for copying magnification setting are connected to the second CPU 202. The switches SW50 and SW51 connected to the second CPU 202 are provided on the scanning path of the optical system and is actuated by the optical system.

The third CPU 203 controls the duplex unit 250. The clutches CL100, CL101, CL102 and CL103, and the main motor of the duplex unit 250 are connected to the third CPU 203.

(Operation)

Figure 5:
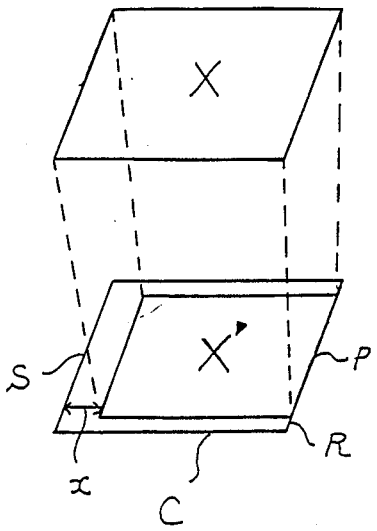
FIGS. 5 to 6 are illustrations of assistance in explaining a manner of forming filing margins on the first and second sides of a copying paper on the trailing edge of the same when the double-side copying mode and the variable magnification shift mode is chosen, according to the first embodiment of the present invention.
Figure 6:
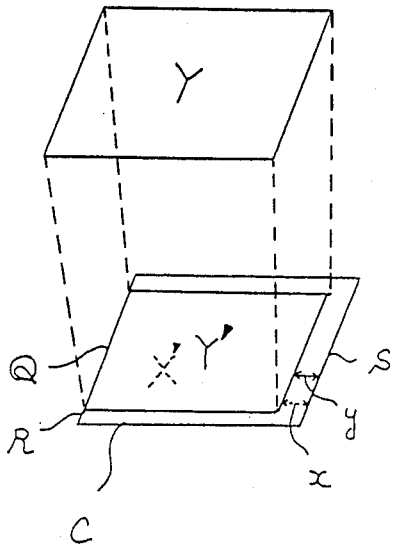

The manner of copying operation, when both the double-side copying mode and the variable magnification shift mode are chosen by means of the double-side copying mode key 501 and the variable magnification shift mode key 503, will be described hereunder with reference to FIGS. 5 and 6. In this first embodiment, a filing margin is formed on the trailing edge of a copying paper when the variable magnification shift mode is chosen.

A reduced image X' of a first document X is copied on the first side of a copying paper C with the leading edge P thereof coinciding with the leading edge R of the copying paper C. The magnification is dependent on the width of a desired filing margin. For example, in forming a filing margin of 10 mm in width along the shorter side of a copying paper of size A4 having a longer side of 297 mm in length, the magnification is; $(297-10)\div 297\approx 0.966$. Thus, a filing margin of 10 mm is in width formed on the first side of the copying paper C along the trailing edge of the same.

The copying paper C carrying an image on the first side thereof is inverted upside down and front side back by the duplex unit 250, and then the copying paper C is set to the image forming unit for copying on the second side of the copying paper C. Since the copying paper C is inverted, the copying paper C is fed with the S which has been the trailing edge in the previous copying cycle leading ahead. If the copying paper is fed at the normal feed timing, for copying on the second side, the leading edge of a reduced image Y' of a second document Y will coincide with the S to form a filing margin on the wrong edge of the copying paper C. Therefore, as illustrated in FIG. 6, the paper feed timing is advanced relative to the normal paper feed timing to make the other R of the copying paper C coincide with the trailing edge Q of a reduced image Y' of the second document Y. Consequently, a filing margin y of 10mm in width is formed on the second side of the copying paper along the S of the same.

The manner of operation of the copying machine of the present invention will be described hereinafter with reference to flow charts.

Figure 7:
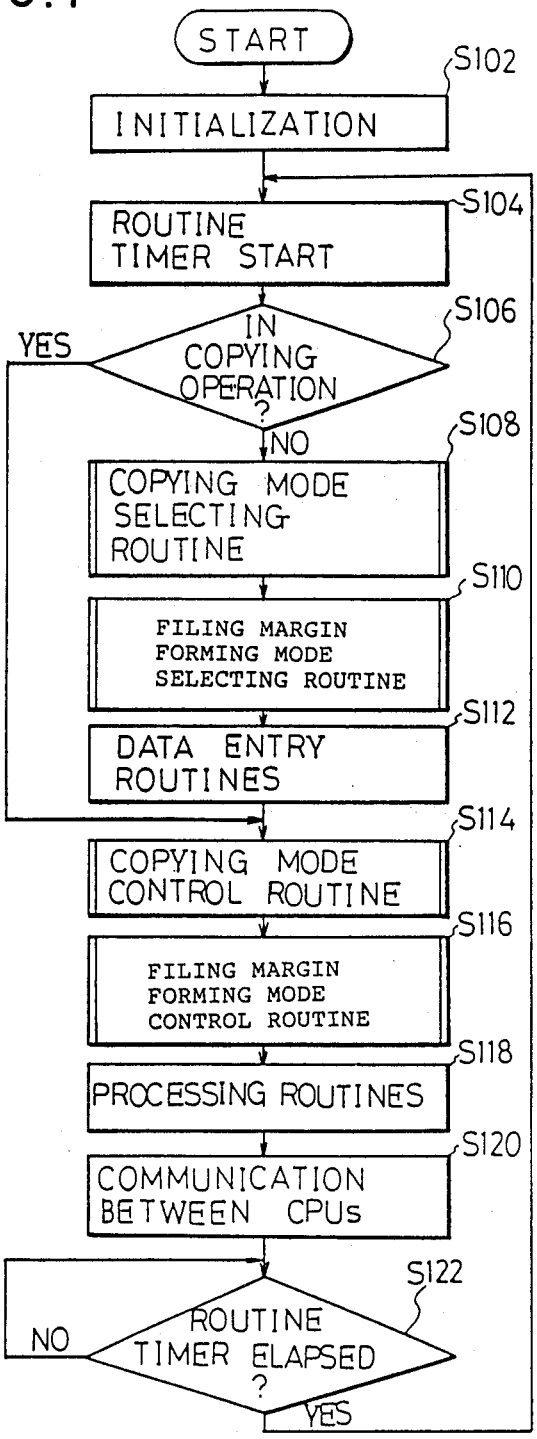
FIG. 7 is a flow chart of a main routine to be executed by the control unit.

(A) Main Routine:

Referring to FIG. 7 showing a flow chart of a main routine to be executed by the control unit, upon the connection of the copying machine to a power source to start the copying operation, the control circuit is initialized at step S102, then a routine timer for regulating the cycle time of the routine is set at step S104, and then a decision is made at step S106 as to whether or not the copying machine is in copying operation.

Then, steps S108 to S122 are executed.

(1) Step S108:

A copying mode, namely, either the double-side copying mode or the single-side copying mode, is selected by pressing the key 501 or 502. Since the routine of this step is well known, the description thereof will be omitted.

(2) Step S110:

One of the filing margin mode, the variable magnification shift mode or the ordinary copying mode is selected by pressing the key 503 or 504. The routine will be described hereinafter.

In the filing margin mode, the paper feed timing is advanced (or delayed) by a time corresponding to a filing margin when the single-side copying mode is selected, and the paper feed timing for copying on the first side is advanced and the paper feed timing for the second side is delayed (or reverse) by a time corresponding to the filing margin when the double-side copying mode is selected.

In the variable magnification shift mode, the image of a document is copied on a reduced scale so that part of the image will not be missed when the copying position is shifted to provide a filing margin. When only one side of a copying paper is to be copied, namely, in the single-side copying mode, the copying paper is fed at the normal paper feed timing so that the leading edge of the document coincide with the leading edge of the copying paper; when both the sides of a copying paper are to be copied, namely, in the double-side copying mode, the copying paper is fed at the normal paper feed timing for copying on one side of the copying paper, while the paper feed timing is advanced so that the leading edge of the document coincide with the trailing edge of the copying paper for copying on the other side of the copying paper. In the ordinary copying mode, the leading edge of the document coincides with the leading edge of the copying paper regardless of the copying magnification.

(3) Step S112:

The keys (numeric keys and magnification setting keys) of the control panel are operated. Since the manner of operation of those keys is well known, the description thereof will be omitted.

(4) Step S114:

The copying paper feed operation and the copying operation are controlled according to the mode of operation selected at step S108. The paper feed timing is controlled so that the leading edge of the document coincides with the leading edge of the copying paper regardless of the copying magnification. Since the mode of the control operation is the same as that disclosed in U.S. Pat. No. 4,129,377, the description thereof will be omitted.

The routine for controlling the duplex unit 250 among the routine for copying paper feed control is carried out by the third CPU 203.

(5) Step S116:

The operation of the filing margin mode and the variable magnification shift mode is executed according to the mode selected at step S100. The routine will be described in detail hereinafter.

In the filing margin mode and the variable magnification shift mode, the operation of the clutch CL1 for the timing rollers 26 is controlled by means of a timer, while in the variable magnification shift mode the lens 14 and mirror 15 of the optical system are controlled by the second CPU 202 and, when necessary, the operation of the clutch CL1 for the timing rollers 26 is controlled by means of the timer.

(6) Step S118:

Temperature regulation, the operation of the output signals of the sensors, and the control of the scanning operation by the second CPU 202 are executed. Since the routine for those operation is well known, the description thereof will be omitted.

(7) Step S120:

Communication between the three CPUs is executed.

(8) Step S122:

After the foregoing routines are completed and the time set at step S104 has elapsed, the routine returns to step S104.

Figure 8:
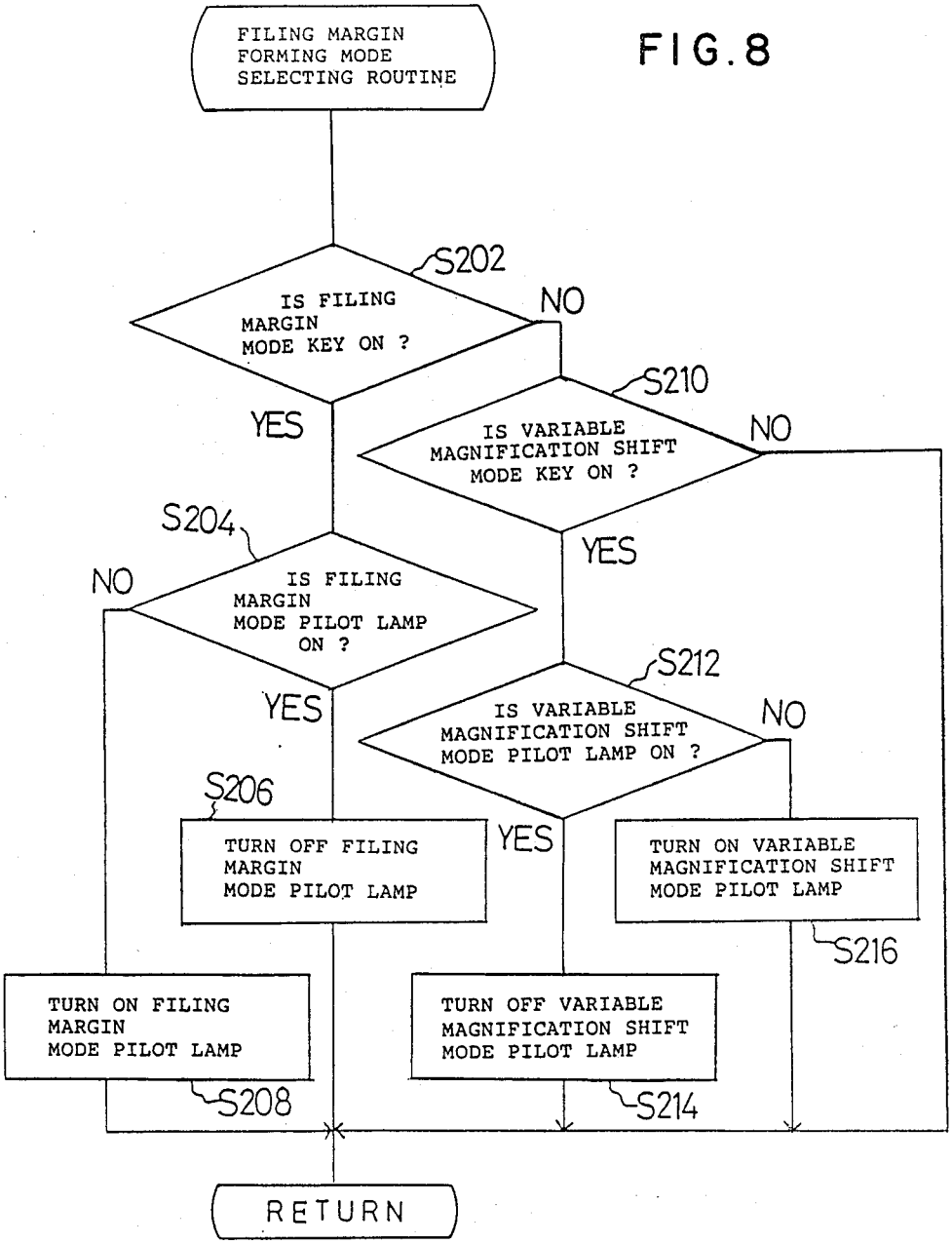
FIG. 8 is a flow chart of a subroutine to be executd at step s110 of the main routine shown in FIG. 5.

(B) Subroutines:

FIG. 8 shows a flow chart of a subroutine to be executed at step S110. At step S202, a decision is made as to whether or not the filing margin mode key 504 is pressed. When the decision is YES, a decision is made at step S204 as to whether or not the filing margin mode is now selected. When the decision at step S204 is YES, the filing margin mode is cancelled at step S206 and, when the decision at step S204 is NO, the filing margin mode is set at step S208.

When it is decided at step S202 that the filing margin mode key 504 is not pressed, the routine goes to step S210 to make a decision as to whether or not the variable magnification shift mode key 503 is pressed. When the decision at step S210 is YES, the routine goes to step S212 to make a decision as to whether or not the variable magnification shift mode is selected and, when the decision at step S210 is NO, the routine returns to the main routine.

When it is decided at Step S212 that the variable magnification shift mode is selected, the routine goes to step S214, where the variable magnification shift mode is cancelled. When it is decided at step S212 that the variable magnification shift mode is now not selected, the routine goes to step S216, where the variable magnification shift mode is set.

Thus, the mode is inverted depending on the condition of the filing margin mode key 504 or the variable magnification shift mode key 503.

The routine returns to the main routine from steps S206, S208, S214 and S216.

Figure 9:
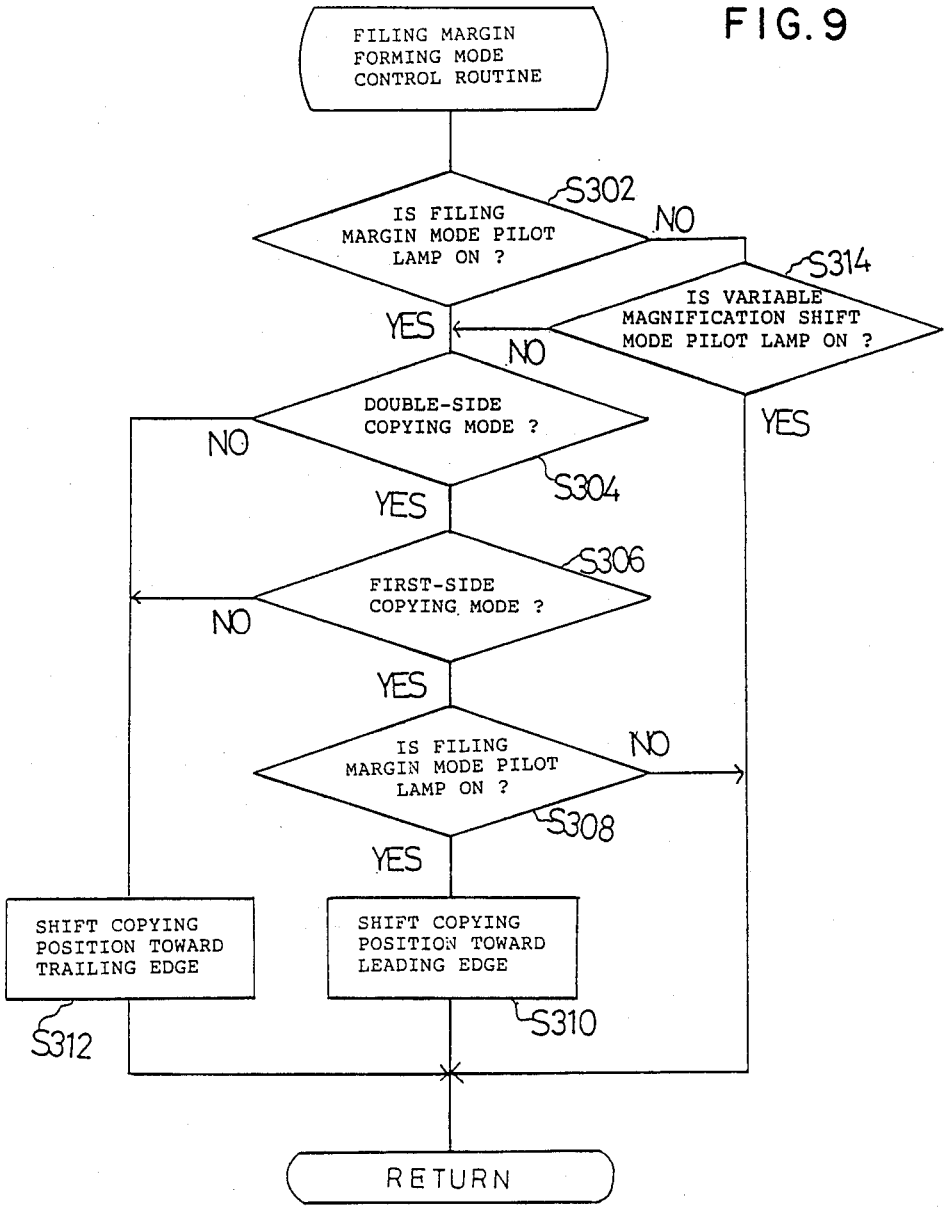
FIG. 9 is a flow chart of a subroutine to be executed at step s116 of the main routine shown in FIG. 7, according to the first embodiment of the present invention.

FIG. 9 shows a flow chart of a subroutine to be executed at step S116.

At step S302, a decision is made as to whether or not the filing margin mode is selected. When the decision at step S302 is NO, the routine goes to S314, where a decision is made as to whether or not the variable magnification shift mode is selected.

When the filing margin mode or the variable magnification shift mode is selected, the routine goes to S304, where a decision is made as to whether or not the double-side copying mode is selected.

When the double-side copying mode is not selected or when the double-side copying mode is selected and the first side copying mode is not selected (S306), the routine goes to step S312, where the copying position is shifted toward the trailing edge of the copying paper by a distance corresponding to a filing margin.

When it is decided at step S306 that the first side copying mode is selected and the filing margin mode is selected (S308), the copying position is shifted toward the leading edge of the copying paper by a distance corresponding to a filing margin (S310).

(THE SECOND PREFERRED EMBODIMENT)

In the foregoing first embodiment, a filing margin is formed on the trailing edge of a copying paper when the reduced copying mode is chosen. However, the filing margin may be formed on the leading edge of the copying paper.

Figure 10:
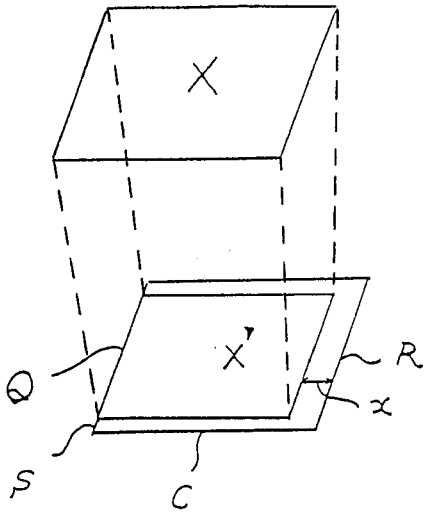
FIGS. 10 and 11 are illustrations of assistance in explaining a manner of forming filing margins on the first and second sides of a copying paper on the leading edge when the double-side copying mode and the variable magnification shift mode are chosen, according to the second embodiment of the present invention.
Figure 11:
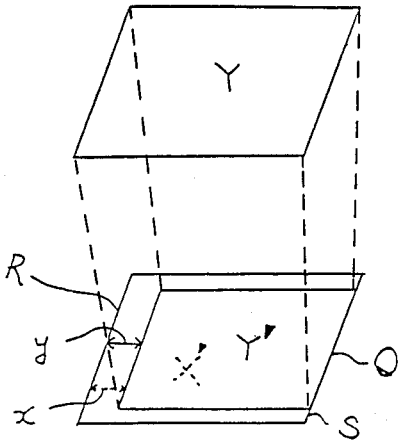

FIGS. 10 and 11 are illustrations of assistance in explaining a manner of forming filing margins on the first and second sides of a copying paper on the leading edge of the same when the double-side copying mode and the variable magnification shift mode are chosen.

First, the copying paper feed timing is advanced relative to the normal copying paper feed timing (a normal copying paper feed timing to make the leading edge of a reduced image of a document coincides with the leading edge of a copying paper) to make the trailing edge S of a copying paper C coincide with the trailing edge Q of a reduced image X' of a first document X to form a filing margin x on the first side of the copying paper C on the leading edge R of the same to copy the first document X on the first side of the copying paper C. Then, the duplex unit 250 inverts the copying paper C carrying an image copied on the first side thereof. Then the copying paper C is fed at the normal copying paper feed timing to make the trailing edge S of the copying paper C coincide with the leading edge Q of a reduced image Y' of a second document Y to copy the second document Y on the second side of the copying paper C and to form a filing margin y on the leading edge R on the copying paper C.

Figure 12:
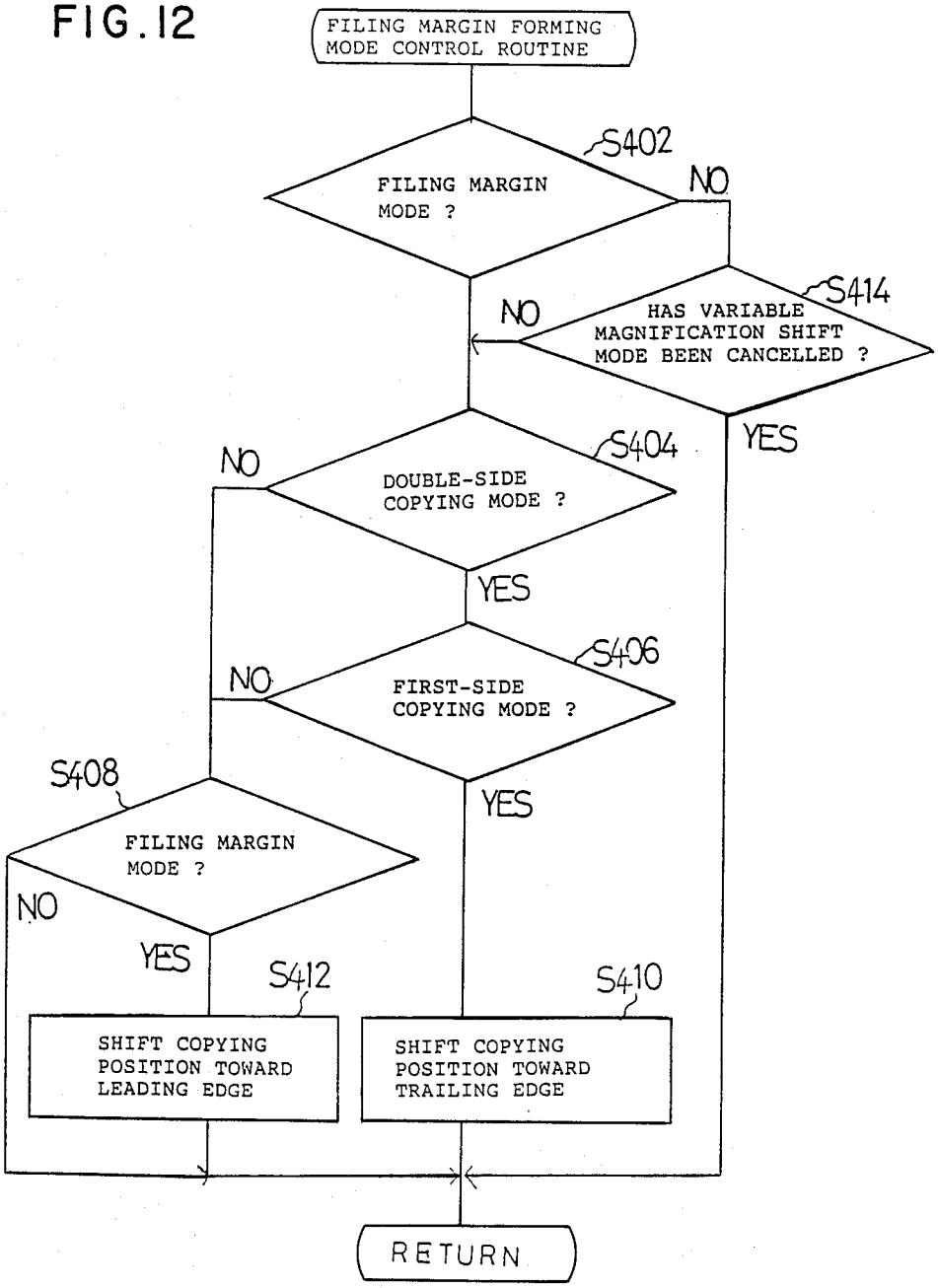
FIG. 12 is a flow chart of a subroutine to be executed at step s116 of the main routine shown in FIG. 7 according to the second embodiment of the present invention.

Procedure of controlling such a copying mode will be described with reference to FIG. 12.

At step S402, a decision is made as to whether or not the filing margin mode has been chosen. When the decision at step S402 is NO, a decision is made at step S414 as to whether or not the variable magnification shift mode has been chosen.

When the filing margin mode or the variable magnification shift mode has been chosen, the routine goes to step S404, where a decision is made as to whether or not the double-side copying mode has been chosen. When the double-side copying mode has not been chosen or when the double-side copying mode has been chosen and the first side copying mode has not been selected (S406), the routine goes to step S408, where the copying position is shifted toward the leading edge of the copying paper by a distance corresponding to a filing margin provided that the filing margin adjusting mode has been chosen.

When the decision at step S406 is YES, namely, when the first side copying mode has been chosen, the copying position is shifted toward the trailing edge of the copying paper by a distance corresponding to the filing margin at step S410.

According to the present invention, when the double-side copying mode and the variable magnification shift mode are selected simultaneously, the respective images of first and second documents or both sides of a double-sided document, having no filing margin, are copied on a reduced scale, the reduced image of the first document or the first side of the document is copied on the first side of a copying paper at the normal copying position, and the reduced image of the second document or second side of the document is copied on the second side of the copying paper at a position shifted by a distance corresponding to a filing margin from the normal copying position.

As described in detail with reference to the preferred embodiments, according to the present invention, in copying images on both sides of a single copying paper, respectively, the images are not missed and filing margins are formed on the both sides of the copying paper on the same edge of the copying paper.

What is claimed is:

1. A copying machine comprising:

image forming means capable of operating in a single-side copying mode in which an image of a document is formed on one side of a copying paper, and in a double-side copying mode in which images of documents are formed on both sides of a copying paper, respectively, copying mode selecting means for selecting either the single-side copying mode or the double-side copying mode;

filing margin forming means for forming an image of a document on a copying paper on a reduced scale to form a filing margin in a direction of conveyance of the copying paper;

filing margin forming mode selecting means for actuating said filing margin forming means to form a filing margin; and control means for making the leading edge of a copying paper coincide with the leading edge of an image of a document in copying the image of the document on the first side of the copying paper and for making the leading edge of the copying paper coincide with the trailing edge of an image of a document in copying the image of the document on the second side of the copying paper, when both the double-side copying mode and the filing margin forming mode have been chosen.

2. A copying machine comprising:

image forming means capable of operating in a single-side copying mode in which an image of a document is formed on one side of a copying paper and in a double-side copying mode in which images of documents are formed on both sides of a copying paper, respectively;

copying mode selecting means for selecting either the single-side copying mode or the double-side copying mode;

filing margin forming means for forming an image of a document on a copying paper on a reduced scale to form a filing margin in a direction of conveyance of the copying paper;

filing margin forming mode selecting means for actuating said filing margin forming means to form a filing margin; and control means for making the trailing edge of a copying paper coincide with the trailing edge of an image of a document in copying the image of the document on the first side of the copying paper and for making the trailing edge of a copying paper coincide with the leading edge of an image of a document in copying the image of the document on the second side of the copying paper, when both the double-side copying mode and the filing margin forming mode have been chosen.

3. A copying machine capable of selectively applying a plurality of magnifications and making the leading edge of a copying paper coincide with the leading edge of an image of a document irrespective of magnification, which comprises:

copying means which copies an image of a first document on a first side of a copying paper fed to an image forming unit, inverts the same copying paper carrying an image copied on the first side thereof so that the copying paper is turned upside down and the leading edge and trailing edge thereof are reversed, refeeds the inverted copying paper to the image forming unit, and copies an image of a second document on the second side of the same copying paper;

filing margin forming command input means; and copying operation control means which, in response to a filing margin forming command, makes the leading edge of a copying paper coincide with the leading edge of an image of a first document and copies the image of the first document on the first side of the copying paper on a predetermined reduced scale, and then makes the leading edge of the same copying paper coincide with the trailing edge of an image of a second document and copies the image of the second document on the second side of the same copying paper on the predetermined reduced scale.

4. A copying machine capable of selectively applying a plurality of magnifications and making the leading edge of a copying paper coincide with the leading edge of an image of a document irrespective of magnification, which comprises:

copying means which copies an image of a first document on the first side of a copying paper fed to an image forming unit, inverts the same copying paper carrying the image on the first side thereof so that the copying paper is turned upside down and the leading edge and trailing edge thereof are reversed, refeeding the inverted copying paper to the image forming unit, and copies an image of a second document on the second side of the same copying paper;

filing margin forming command input means; and copying operation control means which, in response to a filing margin forming command, makes the trailing edge of a copying paper coincide with the trailing edge of an image of a first document, copies the image of the first document on the first side of the copying paper on a predetermined reduced scale, and then makes the trailing edge of the same copying paper coincide with the leading edge of an image of a second document, and copies the image of the second document on the second side of the same copying paper on a predetermined reduced scale.

* * * * *